US007901754B2

(12) United States Patent
Nicastri

(10) Patent No.: US 7,901,754 B2
(45) Date of Patent: Mar. 8, 2011

(54) FRAMES AND CANVASSES WITH A DOUBLE HOOKING AND FASTENING SYSTEM, TO BE WORN OR APPLIED ON VARIOUS OBJECTS, MADE WITH A SOFT MATERIAL, CLOTH OR LEATHER GOODS, TO BE ADDED TO ANY TYPE OF CLOTHES, FITTINGS FOR CLOTHES, FURNISHINGS AND INTERIOR DECORATION, IN AN INTERCHANGEABLE WAY

(76) Inventor: Francesco Nicastri, Gioia Del Colle (IT)

( * ) Notice: Subject to any disclaimer, the term of this patent is extended or adjusted under 35 U.S.C. 154(b) by 183 days.

(21) Appl. No.: 12/296,653

(22) PCT Filed: Mar. 20, 2007

(86) PCT No.: PCT/IB2007/000789

§ 371 (c)(1),
(2), (4) Date: Dec. 9, 2008

(87) PCT Pub. No.: WO2007/110760

PCT Pub. Date: Oct. 4, 2007

(65) Prior Publication Data

US 2009/0117296 A1 May 7, 2009

(30) Foreign Application Priority Data

Mar. 27, 2006 (IT) ..... BA2006A0016

(51) Int. Cl.
*B32B 3/06* (2006.01)
*A41D 27/08* (2006.01)

(52) U.S. Cl. ..... 428/99; 428/138; 40/320; 40/661.04; 40/586; 2/244

(58) Field of Classification Search ..... 428/99, 428/100; 40/586, 320, 661.04, 661.11; 2/244
See application file for complete search history.

(56) References Cited

U.S. PATENT DOCUMENTS 5,636,385 A * 6/1997 Harrison ..... 2/244

* cited by examiner

*Primary Examiner*—Alexander Thomas
(74) *Attorney, Agent, or Firm*—Egbert Law Offices PLLC

(57) ABSTRACT

The present invention is a system and related device for an easy and simple hooking of graphic representations, for example paintings and prints. The representations are made on a support of thin and soft material, for example cloth or leather goods, which can be applied, in an interchangeable way, on any kind of clothes, fittings for clothes, furnishings and interior decorations.

1 Claim, 4 Drawing Sheets

FRAMES AND CANVASSES WITH A DOUBLE HOOKING AND FASTENING SYSTEM, TO BE WORN OR APPLIED ON VARIOUS OBJECTS, MADE WITH A SOFT MATERIAL, CLOTH OR LEATHER GOODS, TO BE ADDED TO ANY TYPE OF CLOTHES, FITTINGS FOR CLOTHES, FURNISHINGS AND INTERIOR DECORATION, IN AN INTERCHANGEABLE WAY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to frames and canvasses with a double hooking and fastening system, to be worn or applied on various objects, made with a soft material, cloth or leather goods, to be added to any type of clothes, fittings for clothes, furnishings and interior decoration, in an interchangeable way.

2. Description of Related Art Including Information Disclosed Under 37 CFR 1.97 and 37 CFR 1.98

Exclusivity and personalization are some of the reasons that move a buyer of a product, whether it is an object or a article of clothing. The present invention concerns a system and related device for an easy and simple hooking of graphic representations, for example paintings and prints, made on a support of thin and soft material, for example cloth or leather goods, which can be applied, in an interchangeable way, on any kind of clothes, fittings for clothes, furnishings and interior decoration.

To make it possible for the user to make a product, for example, an article of clothing or an interior decoration object, unique, the product is endowed with something that can identify its owner. At present there are various ways to personalize clothing, fittings for clothes, objects for furnishing and interior decoration. Among these ways are embroidery, which can be used for all products and clothes, Modern embroidery equipment operates automatically with many colors. There is also silk-screen printing, suitable for small productions. There are no limitations to print dimensions and to number of colors. There is also heat transfer printing, which allows the user to make prints of very small dimensions and with a small production, not requiring use of printing systems. It is suggested for printing with full colors and precise details suitable for most clothes, embossing types of printing are required, such as special heat silk-screen operations obtained with special inks which are in a pleasant way "inflated", being very good for knitted fabrics and shirts. There are other applications, such as patches, badges or labels, being embroidered or thermoformed and being quickly sewn on every garment piece, in any position.

However, all of the above systems show disadvantages of not being movable. As a result, interchangeability is not allowed when the image shown on the object or garment must be changed. Another disadvantage is the difficulty to personalize a product. In order to really personalize, it is necessary to use one of the above mentioned processes that often are difficult and laborious to carry out or even impossible for the final user without availability of suitable means. Another inconvenience is to be found in wearing of a printed decoration applied on cloths or leather goods after much washing, especially washing the decoration of garments.

BRIEF SUMMARY OF THE INVENTION

An object of the present invention is to find a solution to the above problems by means of giving a system and corresponding devices for an easy and quick fastening of graphic representations. The images are carried out on a thin and soft material support, which can be applied, in an interchangeable way, on any kind of a garment piece or decoration object. For the above-mentioned purpose, the present invention solves the problem to allow a strong personalization of all garment pieces, fittings for clothes and decoration articles, for example settees, arm-chairs, curtains, lamps, and other possibilities are given to wear/use, in a not movable and interchangeable way, graphical representations that can also reveal owner's personality.

Another object of the present invention is to supply a system and device that allow personalization of any kind of a garment, object and decoration article, acquiring such personalization in an exclusive manner.

As an example, the present invention allows the possibility of applying the personalization on any kind of soft material support, being cloth or leather goods, small paintings of known authors or home-made by the same owner of decoration article or wearer of the garment on which the images of the small paintings are to be applied.

For this purpose, the invention allows an easy and original exhibition of the above-mentioned paintings in art galleries with paintings to wear or paintings to collect or paintings to both wear and collect. The specialized shops can promote, in a really full and original way, a well-known artist or not.

Another purpose of the present invention is to allow removal of graphic applications, otherwise not movable, by making the decoration article or the garment piece washable.

These and other objects are obtained by these frames and clothes, made with soft material and with a double system of hooking and of fastening, suitable to be worn/applied on garments, fittings for garments, furnishings and decoration articles, in an interchangeable way.

BRIEF DESCRIPTION OF THE SEVERAL VIEWS OF THE DRAWINGS

In a preferred embodiment, not being restrictive to further improvements in the field of this invention, help of the four drawings show relevant figures.

DETAILED DESCRIPTION OF THE INVENTION

Figure 1:
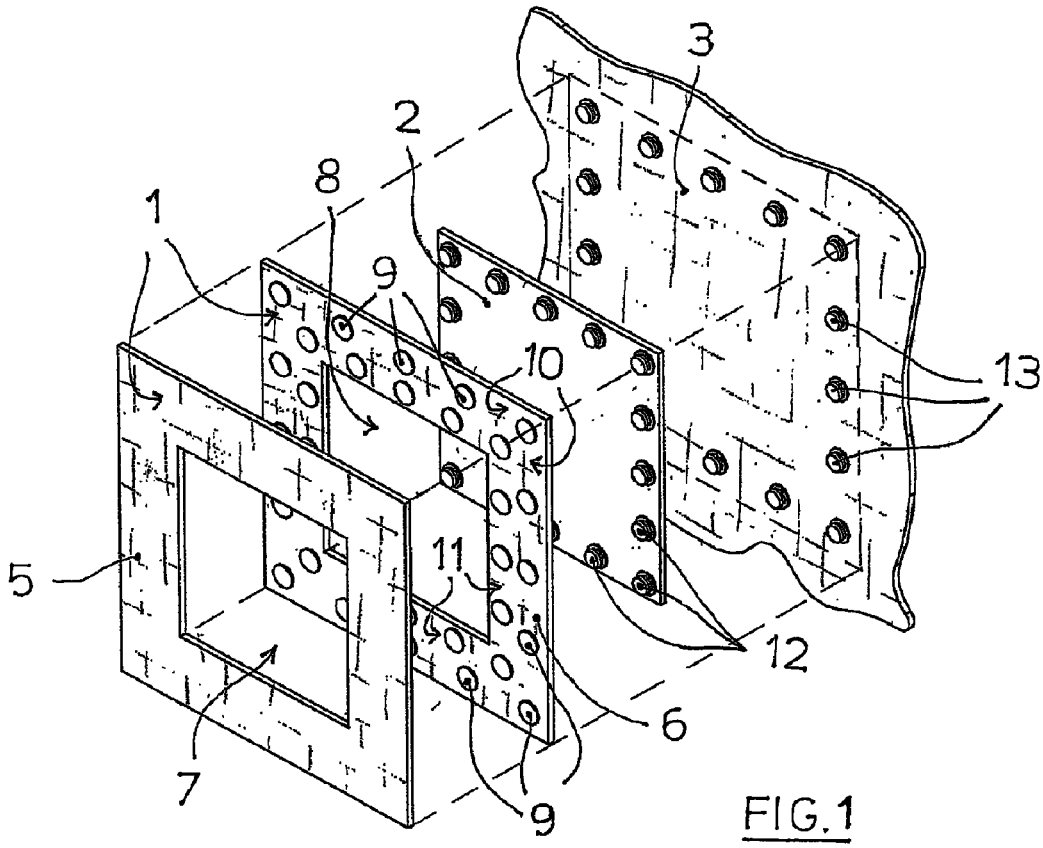
FIG. 1 is an exploded perspective view, in pre-assembly from on outer surface, showing a frame and a canvas before mounting on a support in textile/leather goods by means of a double hooking system with clip buttons.
Figure 2:
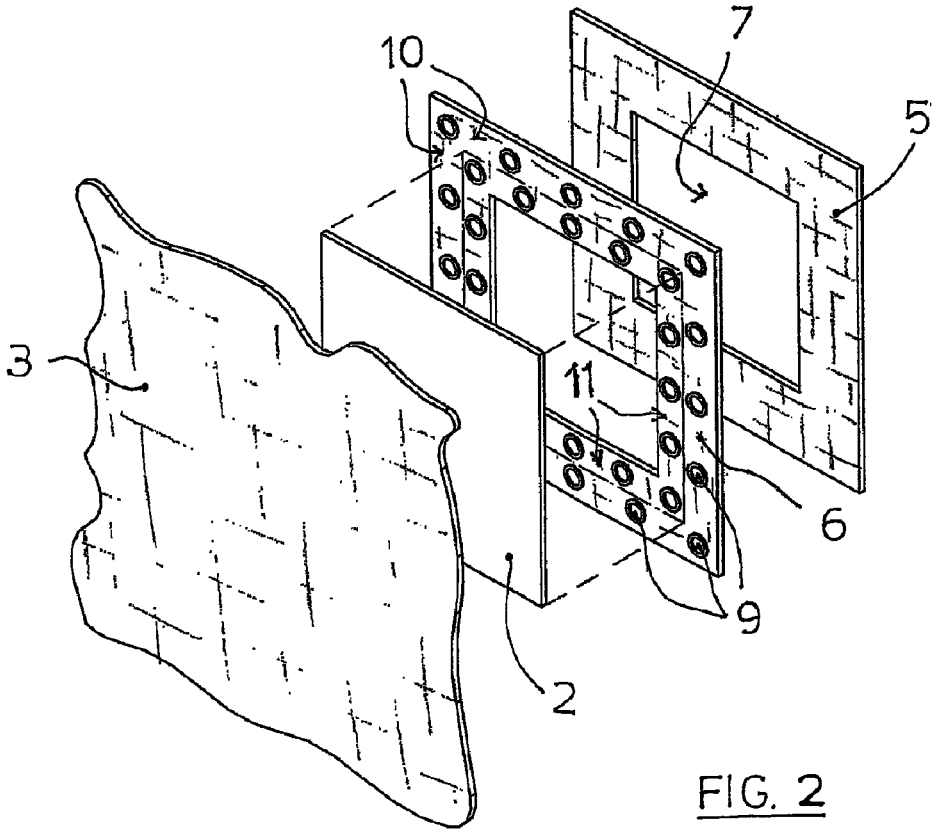
FIG. 2 is another perspective view, in pre assembly from an inner surface, showing the support on the canvas/leather goods, according to the frame and canvas of FIG. 1.
Figure 3:
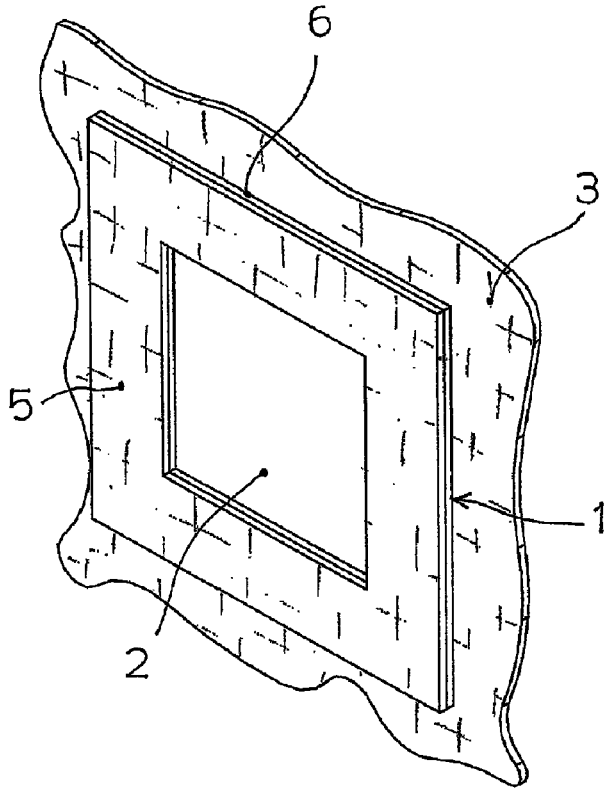
FIG. 3 is a perspective view from the outside surface of the frame and canvas, shown in both FIGS. 1 and 2, after assembly of one with the other and mounting on a support on the canvas/leather goods.
Figure 4:
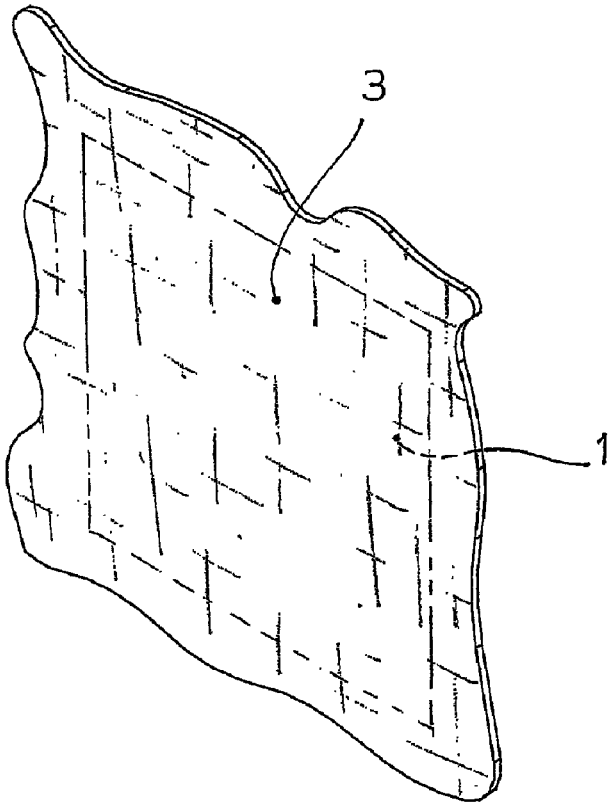
FIG. 4 is another perspective view from an inner surface, showing the support on the canvas/leather goods, according to the frame and canvas of FIG. 3.

A device of the present invention is shown in a preferred embodiment before assembly in FIGS. 1 and 2 and after assembly in FIGS. 3 and 4. The device is made of a frame 1 with a double layer on an outside, an intermediate canvas 2 and a support 3. All three are soft materials, including such things as clothing, leather goods or other similar materials. There is also a hooking system of a clip-button type. Frame 1 is made of two cloth layers, one external layer 5 and one internal layer 6, each having a quadrangular shape and centered openings of the same dimensions, respectively 7 and 8. The internal layer 6 of the frame has clip buttons applied thereon, for example a female or male clip end 9, being located along a perimeter of the internal layer 6 in two parallel rows, one row more external 10 and one row more internal 11.

The assembly of frame 1 can take place in two ways. First, belts of canvas are cut to make layers 5 and 6. In making a double hooking system inside belts of layer 6, belts are overlapped and sewn, including sewing four angles so that a double layer frame 1 is obtained. Second, two pieces of cloth of a quadrangular shape and with same measures are cut with a quadrangular opening in a center of each of the two overlapped pieces of cloth in order to obtain two layers 5 and 6, to form the double hooking system inside layer 6. Two canvas layers 5 and 6 are sewn and overlapped so that frame 1 is obtained. Layer of cloth 5 of frame 1 functions to conceal the hooking and inside fastening system from the outside. The hooking system is assembled on layer 6, made of two perimeter rows 10 and 11 of female clips 9.

External perimeter rows 10 of female clips 9, located on each internal side of frame 1, allow hooking and fastening of the frame 1 to support 3, which for this purpose is provided with male clips 13 (or as an alternative female ones) which fit together with above mentioned clips 9.

Inside perimeter rows 11 of female type clips 11, located on each internal side of frame 1, have on the contrary function to allow hooking and fastening to the frame 1 of canvas 2 which for this purpose is provided with male type clips 12 (or as an alternative female ones) closely fitting with above mentioned clips 9.

The hooking system by clips allows, for example, in case of washing of support, to take off canvasses, and also, if it was not sewn on support, the frame, allowing interchangeability on the same cloth.

Dimension and shape of frame 1 is a function of canvas 2 that must be applied, and also vice versa. In details, dimensions of canvas must be smaller than those of the frame and in any case slightly bigger than dimensions of openings of the frame.

Figure 5:
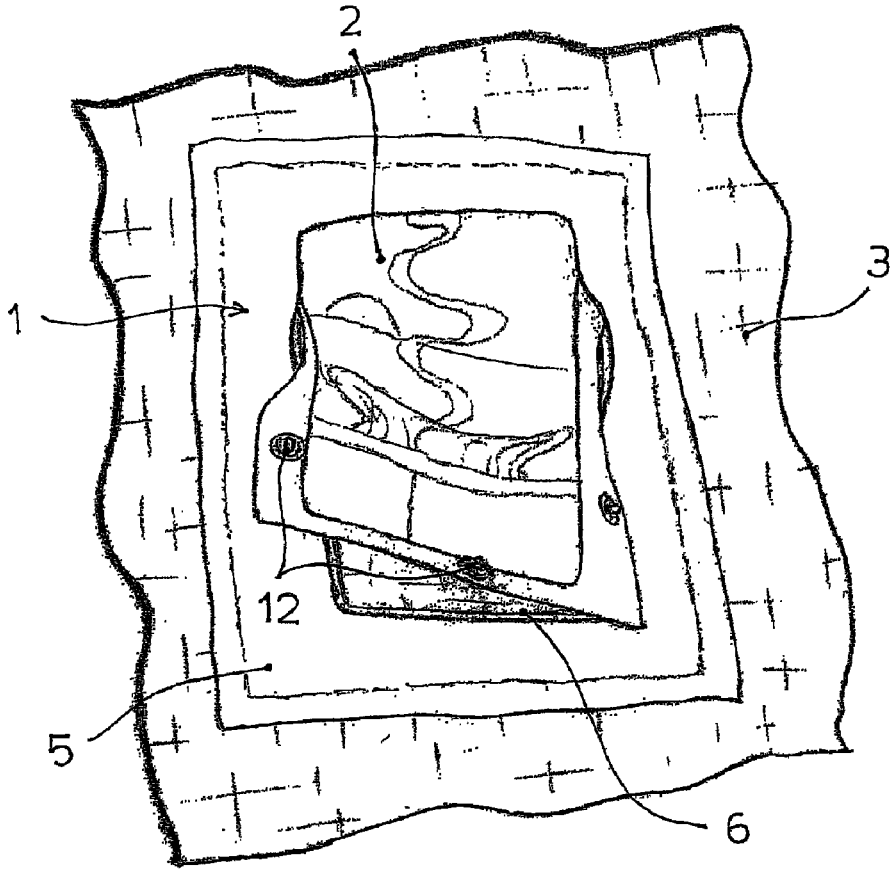
FIG. 5 is a schematic view of a canvas, according to the present invention during clipping operation to a frame sewn on a support of the canvas/leather goods.

In FIG. 5, a frame is shown according to this invention during hooking by means of clips to a frame sewn on a cloth support.

Location and reciprocal distance between external perimeter rows 10 and 11 internal ones of female clips 9 (male) in connection to frame 1 must be exactly the same as regards one to the other location and distance of male (female) clips, respectively 13, in connection with support 3, and 12, in connection with canvas 2.

In order to allow assembly of female type clips 9 and male type 12 and 13, both internal cloth layer 6 of frame 1, and perimeter of frame 2, and surface of support 3, must be provided with suitable holes.

The double hooking and fastening system corresponding to preferred embodiment of above mentioned description is carried out by means of clip buttons. Of course, this system of hooking can be different. For example, other means include: buttonholes made in the frame, which can be fastened by means of buttons sewn on support and on canvas, buttons which can be screwed in foreseen holes, VELCRO™ tapes to be torn away, and seams of the frame on a support, the hooking system being taken away by canvas with frame, etc.

Figure 6:
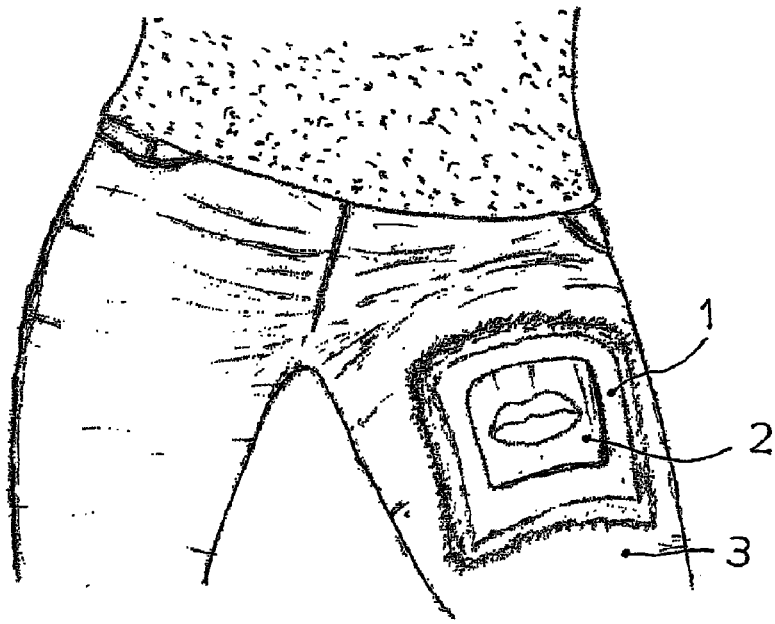
FIG. 6 is a schematic illustration, showing assembly of canvas and frame according to the present invention on trousers.
Figure 7:
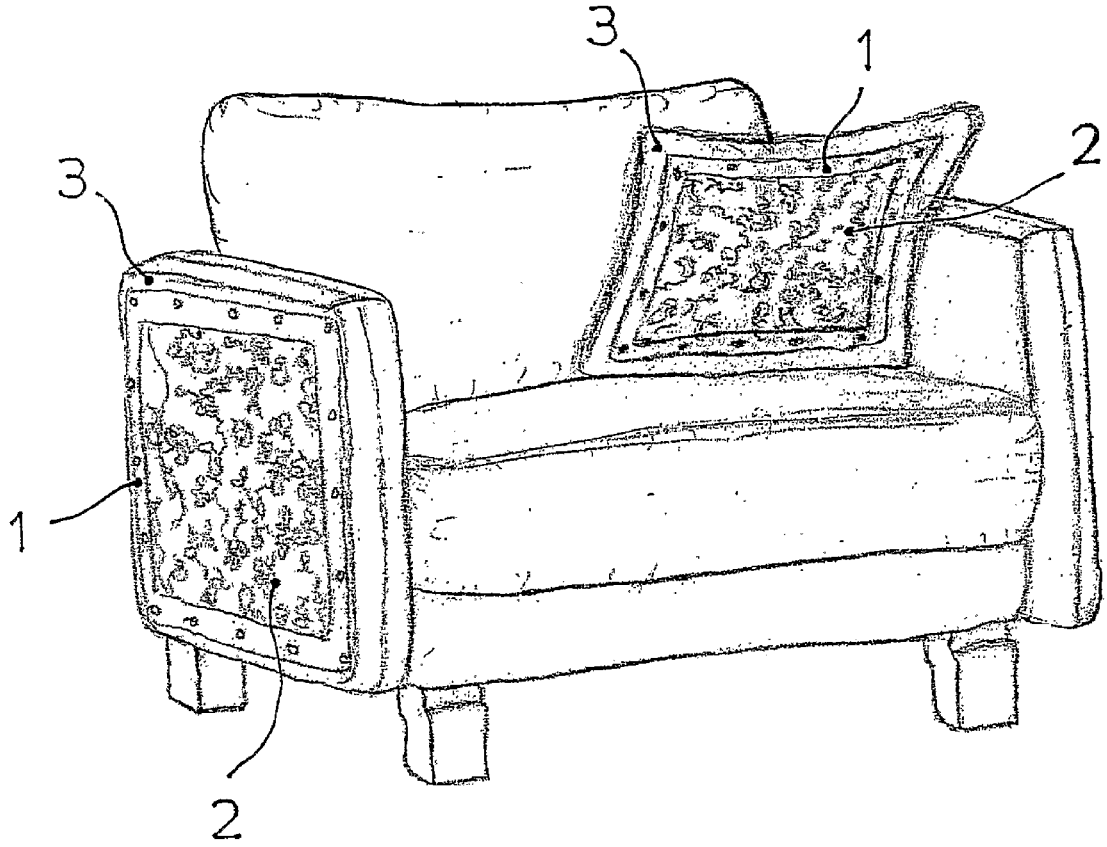
FIG. 7 is a perspective view of an upholstered armchair and a cushion provided with a canvas and a frame according to present invention.

In FIGS. 6 and 7, two examples are shown of assembly of frames and canvasses according to present invention.

In detail, in FIG. 6, an assembly of a canvas and its frame is shown according to the present invention on worn trousers. In FIG. 7, there is an application for an arm of a chair and a cushion.

Frames and canvasses, with a double hooking and fastening system, suitable to be worn/assembled on garment articles, fittings for garment, furnishings and decoration articles, in an interchangeable way concerning present invention are described with help of a preferred embodiment. It is understood that this invention is not confined only to this, on the contrary it is intended to protect other versions and similar adaptations and embodiments.

I claim:

1. A double hooking and fastening system for application to a clothing article comprising:

an external frame formed of an external first layer of cloth and an internal second layer of cloth, said first layer of cloth overlying said second layer of cloth, each of said first layer of cloth and said second layer of cloth having a quadrangular shape and a cental open area, said first layer of cloth and said second layer of cloth having identical dimensions;

an intermediate canvas formed of a thin and soft material, said intermediate canvas having a graphical representation thereon, said second layer of cloth having a plurality of button fasteners attached thereto, said plurality of button fasteners extending along a pair of parallel rows, a first of said pair of parallel rows being close to an outer perimeter of the second layer of cloth than a second of said pair of parallel rows, said plurality of button fasteners extending outwardly of said second layer of cloth so as to face said intermediate canvas, said canvas having a plurality complementary button fasteners releasably engaged with said second of said pair of parallel rows; and a support having a plurality of complementary button fasteners releasably engaged with said first of said pair of parallel rows, said support suitable for attachment to or as part of the clothing article, said graphical representation suitable for facing through said central open area of said first and second layers of cloth.

* * * * *